US006837280B2

(12) United States Patent
Ragazzini et al.

(10) Patent No.: US 6,837,280 B2
(45) Date of Patent: Jan. 4, 2005

(54) UNIT FOR CHECKING THE DOSING OF PHARMACEUTICAL MATERIAL IN A CAPSULE FILLING MACHINE

(75) Inventors: Pierantonio Ragazzini, Forli' Cesena (IT); Elvio Gasperini, Castel S. Pietro Terme (IT); Roberto Trebbi, Castenaso (IT); Enrico Zerbinati, Monterenzio (IT); Riccardo Rivalta, Imola (IT); Nicola Gandolfi, Bologna (IT); Giorgio Tarozzi, Nonantola (IT)

(73) Assignee: I.M.A. Industria Macchine Automatiche S.p.A., Ozzano Emilia (Bologna) (IT)

( * ) Notice: Subject to any disclaimer, the term of this patent is extended or adjusted under 35 U.S.C. 154(b) by 0 days.

(21) Appl. No.: 10/486,914

(22) PCT Filed: Jun. 27, 2003

(86) PCT No.: PCT/IB03/02938

§ 371 (c)(1),
(2), (4) Date: Feb. 23, 2004

(87) PCT Pub. No.: WO2004/004627

PCT Pub. Date: Jan. 15, 2004

(65) Prior Publication Data

US 2004/0172925 A1 Sep. 9, 2004

(30) Foreign Application Priority Data

Jul. 3, 2002 (IT) ..... BO2002A0431

(51) Int. Cl.[7] ..... B65B 1/04

(52) U.S. Cl. ..... 141/83; 53/509; 53/53; 141/73

(58) Field of Search ..... 141/67, 71, 73, 141/80, 83; 53/53, 509

(56) References Cited

U.S. PATENT DOCUMENTS

| | | | | |
|---|---|---|---|---|
| 4,181,360 A | | 1/1980 | Wilson | |
| 5,971,037 A | * | 10/1999 | Ansaloni | 141/83 |
| 6,327,835 B1 | | 12/2001 | Trebbi | |

* cited by examiner

*Primary Examiner*—Steven O. Douglas
(74) *Attorney, Agent, or Firm*—Arent Fox

(57) ABSTRACT

A unit (6) for checking the dosing of pharmaceutical material (M) in a capsule filling machine (1) for the production of capsules (CF) of the type with a capsule lid (C) and a capsule body (F), the machine (1) comprising a fixed structure (15) fitted with a rotary drum (2) for supporting a plurality of capsules (CF) on its edge, opening each capsule (CF) by separating the capsule lid (C) from the capsule body (F), filling the capsule body (F) with a dose of material (M), then closing the capsule body (F) again with the relative capsule lid (C); the rotary drum (2) having a tank (5) containing the pharmaceutical material (M) and supporting a plurality of doser elements (3), each comprising at least one piston (8) sliding inside a hollow cylinder (4) to pick up and compress a dose (DS) of material (M) from the tank (5) and discharge it into a capsule body (F) of a capsule (CF). The unit (6) comprises sensor means (9) attached to each piston (8) for detecting a piston (8) thrust value (V; V1) on the dose (DS) and transmitter means (10) connected to the sensor means (9) for transmitting the value (V; V1) to a receiver element (11; 41) by the telemetric transmission of a relative signal (S; S1), said receiver element (11; 41) being fixed on the machine (1) in at least one zone (P1; P2) of the fixed structure (15). Power supply means (12, 14*a*) are also provided for cyclically activating the sensor means (9) and the transmitter means (10) during drum (2) rotation.

10 Claims, 4 Drawing Sheets

UNIT FOR CHECKING THE DOSING OF PHARMACEUTICAL MATERIAL IN A CAPSULE FILLING MACHINE

TECHNICAL FIELD

The present invention relates to a unit for checking the dosing of pharmaceutical material in a production machine.

In particular, the present invention is advantageously applied in a capsule filling machine for the production of hard gelatin capsules for pharmaceutical use, of the type with a capsule lid and a capsule body containing doses of pharmaceutical material in powder or particulate form, to which the present specification refers but without limiting the scope of the invention.

BACKGROUND ART

Generally speaking, a capsule filling machine for the production of pharmaceutical capsules basically comprises a drum which rotates about a vertical axis of rotation, and a circular fixed tank which holds the pharmaceutical material to be fed into the capsules by dosing.

The drum handles and positions the capsules to be filled with the pharmaceutical material by separating the capsule lid from the capsule body then closing them again once filled. The drum, to which the tank containing the material to be dosed is connected, also has a plurality of doser elements designed to pick up relative doses of material from the tank and, respectively, to deposit each dose in the capsule body before the capsule body is closed again with the relative capsule lid.

According to a known dosing method the doser elements, each consisting of a hollow punch, forming a hollow cylinder and housing a piston moving with alternate motion, perform the following operating steps one after another: a vertical stroke by the hollow cylinder into the tank, for immersion in the pharmaceutical material until the cylinder touches the bottom of the tank, forming a dose or slug of material inside the hollow cylinder; a downward movement by the piston to compress the dose of pharmaceutical material; a subsequent return upward movement by the hollow cylinder with the compressed dose still inside it, to pick up the dose from the tank; finally, with a downward thrust movement by the piston, the compressed dose is released into the relative capsule body, after an axial movement designed to align the capsule body on the raised hollow cylinder, by rotation of the drum.

To correctly pick up the dose then discharge it into the capsule body but, above all, to ensure that each capsule contains a dose of pharmaceutical material whose weight lies within a predetermined weight range, the vertical stroke of the piston operating inside the hollow cylinder is suitably regulated, in both directions, according to values defined as constants and synchronised with the movement of the hollow cylinder.

To check that the weight of the doses of pharmaceutical material in the capsules is correct, one known check method involves the use of precision scales on which capsules taken as samples from a capsule filling machine outfeed portion are placed.

Since such scales have high settling times during weighing steps, this method cannot be used to check all of the capsules produced by the capsule filling machine, as this would greatly slow down the production flow.

To solve the above-mentioned problem, that is to say, to check all of the capsules produced without slowing down the production flow, at present modern capsule filling machines are fitted with check devices designed to detect the downward force of the pistons during the dosing step and to control the piston stroke with feedback if said force gives doses of pharmaceutical material with unacceptable weight values.

In the capsule filling machine described, for example in U.S. Pat. No. 6,327,835, each dosing piston of a drum rotating with alternating motion is fitted with a force sensor, connected by connecting cable transmission systems to a control unit designed to receive, during each pause in the drum alternating motion, a signal relative to a piston compression force value, to compare said value with a predetermined reference value and to send a feedback signal to adjust the piston drive unit during the pharmaceutical material dosing steps.

The control device described in said U.S. patent is validly used only on capsule filling machines with alternating motion but, due to the connecting cable transmission systems, can obviously not be used on a capsule filling machine whose drum rotates continuously at a speed of rotation which can currently be very high.

DISCLOSURE OF THE INVENTION

The aim of the present invention is, therefore, to overcome the above-mentioned disadvantages and the problems of the prior art.

In particular, the aim of the present invention is to provide a control unit which allows an efficient weight check of all of the capsule produced by a capsule filling machine, whether it operates with continuous or alternating motion.

Accordingly, the present invention provides a unit for checking the dosing of pharmaceutical material in a capsule filling machine for the production of capsules of the type with a capsule lid and a capsule body, the machine comprising a fixed structure fitted with a rotary drum for supporting a plurality of capsules on its edge, opening each capsule by separating the capsule lid from the capsule body, filling the capsule body with a dose of pharmaceutical material, then closing the capsule body again with the relative capsule lid. The rotary drum has a tank containing the pharmaceutical material and supports a plurality of doser elements, each comprising at least one piston sliding inside a hollow cylinder to pick up and compress a dose of material from the tank and discharge it into a capsule body of a capsule. The unit is characterised in that it comprises sensor means attached to each piston to detect a piston thrust value on the dose; transmitter means connected to the sensor means for transmitting the value to a receiver element by the telemetric transmission of a relative signal, said receiver element being fixed on the machine in at least one area of the fixed structure. Power supply means are also provided for cyclically activating the sensor means and the transmitter means during drum rotation.

BRIEF DESCRIPTION OF THE DRAWINGS

The technical features of the present invention, in accordance with the above-mentioned aims, are set out in the claims herein and the advantages more clearly illustrated in the detailed description which follows, with reference to the accompanying drawings, which illustrate a preferred embodiment of the invention without limiting the scope of the inventive concept, and in which:

DETAILED DESCRIPTION OF THE PREFERRED EMBODIMENTS OF THE INVENTION

Figure 1:
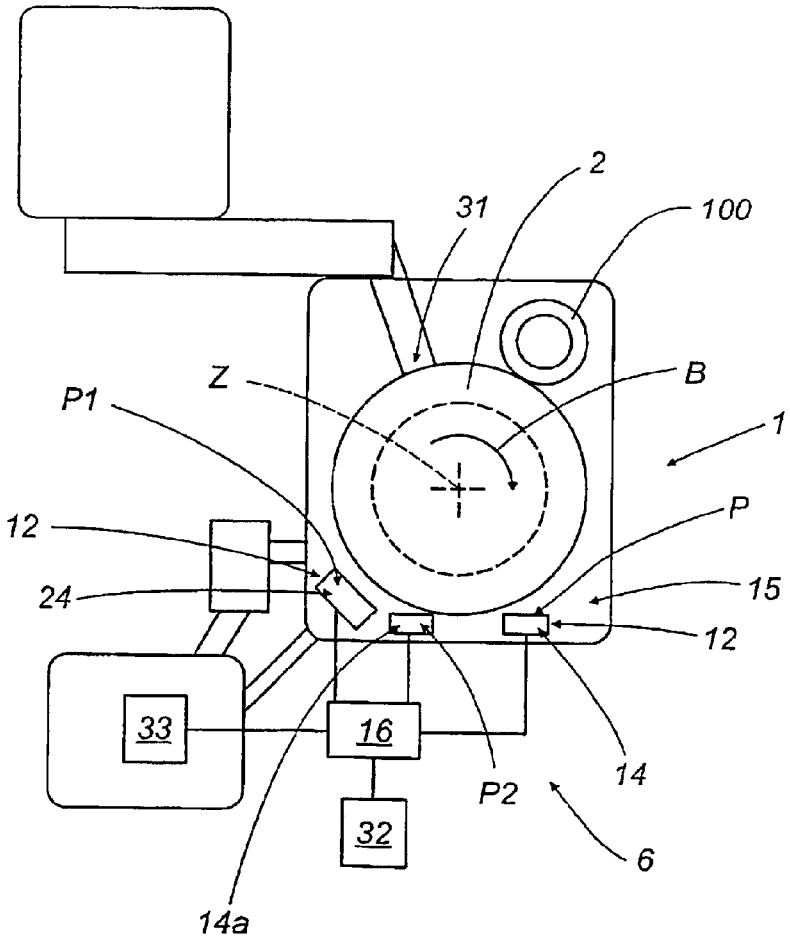
FIG. 1 is a schematic top plan view with some parts cut away for greater clarity, of a capsule filling machine fitted with the unit for checking the dosing of material according to the present invention.
Figure 2:
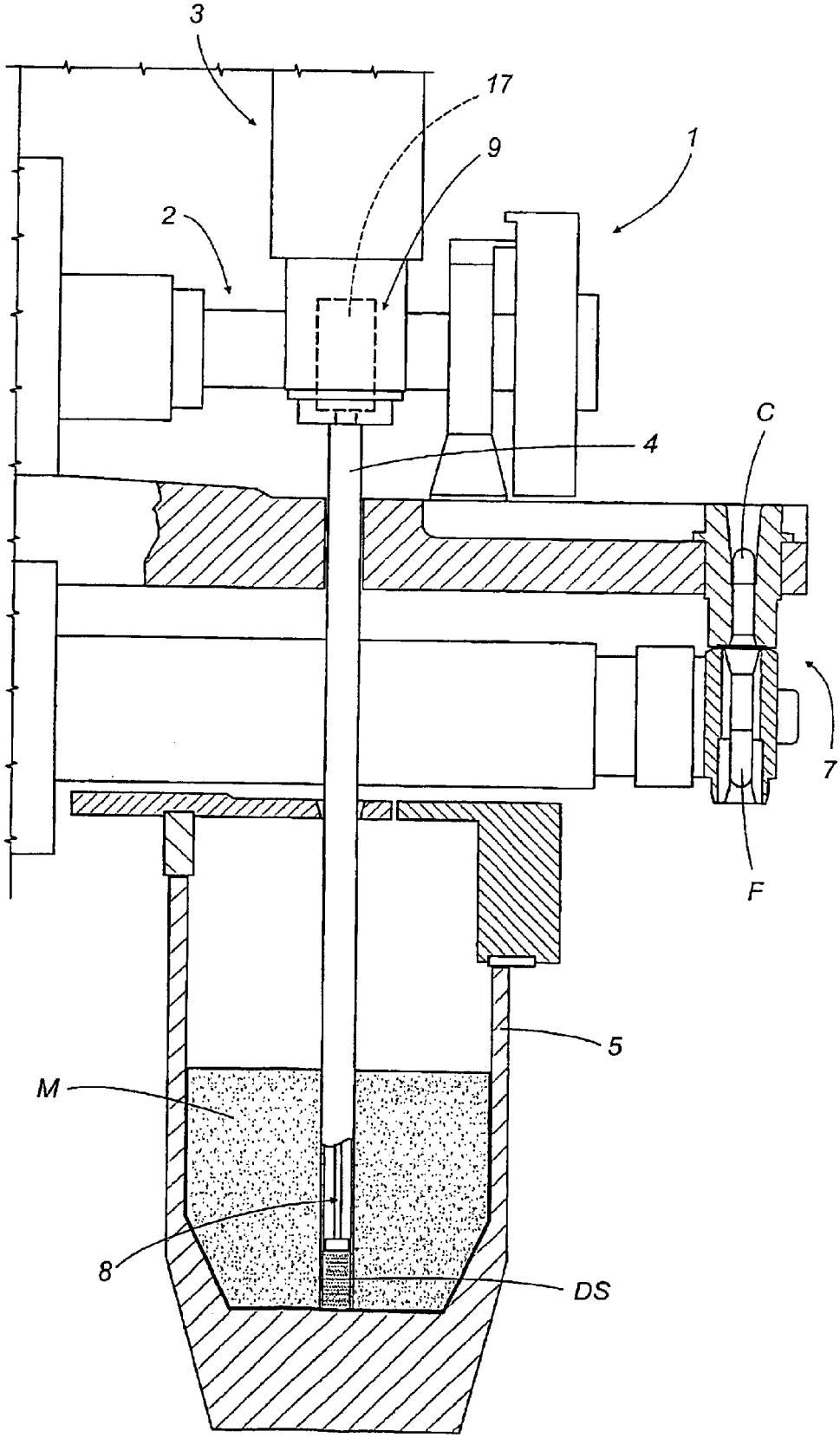
FIG. 2 is a side view, partially in cross-section with some parts cut away, of a portion of the capsule filling machine illustrated in FIG. 1 in an operating position.
Figure 3:
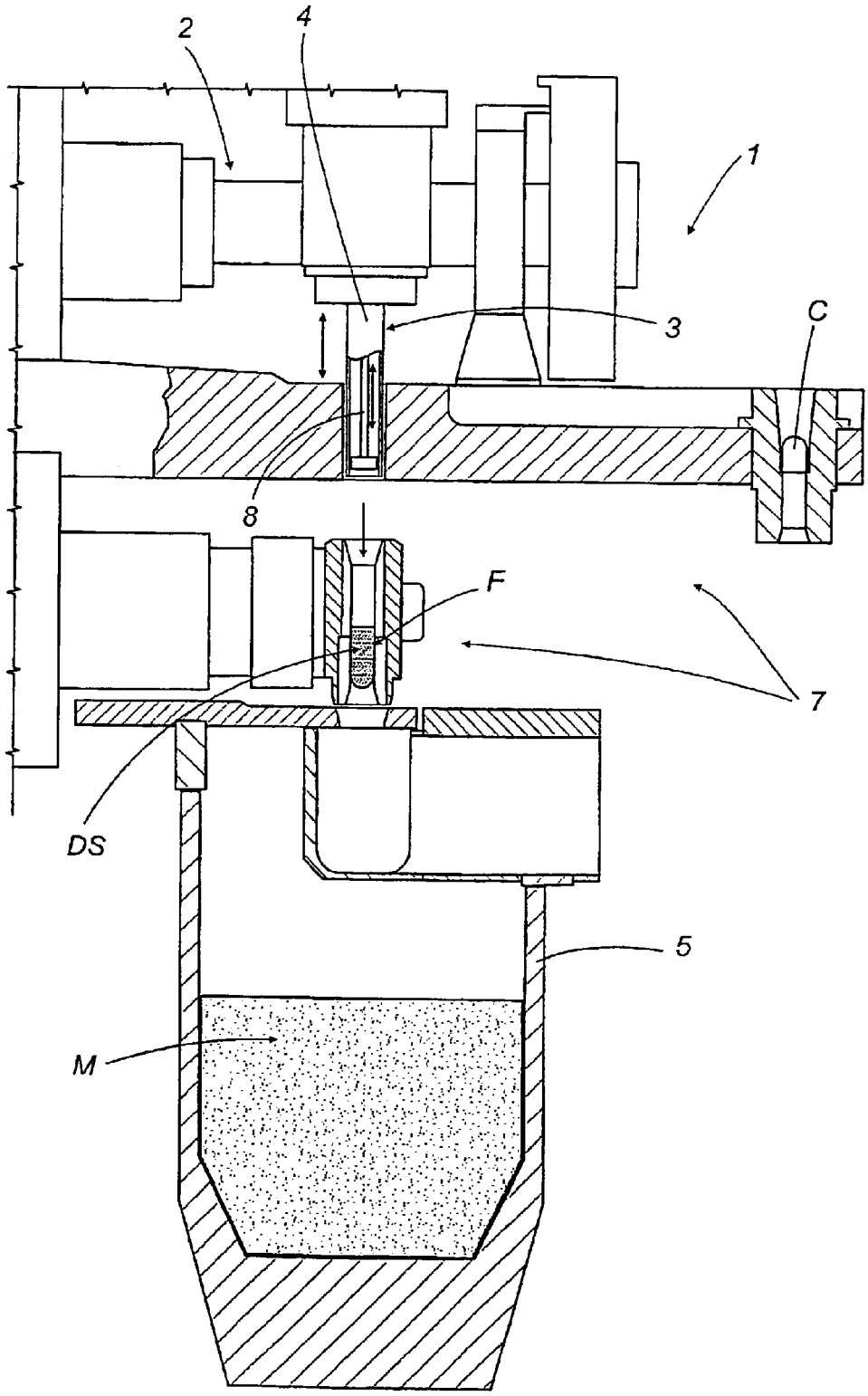
FIG. 3 is a side view, with some parts cut away and others in cross-section, of the capsule filling machine illustrated in FIG. 1 in another operating position.

With reference to FIGS. 1, 2 and 3, the numeral 1 denotes a capsule filling machine for the production of capsules CF of the type with a capsule lid C and a capsule body F containing doses of pharmaceutical material M in powder or particulate form.

The machine 1 basically comprises a drum 2 continuously rotating about a vertical axis Z and in a clockwise direction B in FIG. 1, its edge designed to support the capsules CF in a known way and to handle and position the capsules CF at an angle so that they can be filled with doses of the pharmaceutical material M by separating the capsule lid C from the capsule body F then closing them after filling, with a known method illustrated in FIGS. 2 and 3. The drum 2 is connected to a circular tank 5 containing the pharmaceutical material M supplied to the tank 5 by a material M feed station 100 (FIG. 1).

The drum 2 has a plurality of known doser elements 3, each forming a dosing station and designed to pick up doses DS of material M from the tank 5 then deposit each dose DS in the capsule body F of the capsule CF before the capsule body F is closed again with the relative capsule lid C.

As illustrated in FIGS. 2 and 3, each doser element 3 comprises a piston 8 which moves inside a hollow cylinder 4. It should be noticed that each doser 3 preferably comprises a pair of pistons 8 which move inside respective hollow cylinders 4, but for the sake of simplicity in this description and below reference is only made to a single piston 8 and a relative cylinder 4 without in any way limiting the scope of application of the invention.

The cylinder 4 moves vertically in both directions, driven by known drive means, not illustrated, between a lowered position (FIG. 2) in which the hollow cylinder 4 is immersed in the tank 5, and a raised position in which the cylinder 4 is outside the tank 5 (FIG. 3).

The piston 8 is designed to slide vertically inside the cylinder 4, again in both directions, driven by known drive means, not illustrated, in such a way that, in practice, each doser element 3 performs the following operating steps one after another: a vertical stroke into the tank 5 by the hollow cylinder 4 so that it is immersed in the pharmaceutical material M until the cylinder touches the bottom of the tank 5, forming a dose DS or slug of material M inside the hollow 4 (FIG. 2); a piston 8 downward movement to compress the dose DS of pharmaceutical material M (FIG. 2); a subsequent hollow cylinder 4 return upward movement with the compressed dose DS of material M still inside the cylinder 4, to pick up the dose from the tank 5; finally, with a piston 8 downward thrust, release of the compressed dose DS into the relative capsule body F (FIG. 3) carried by slide means 7 on the drum 2. In practice, the dose DS of material M to be picked up is defined by the diameter of the cylinder 4, by the piston 8 initial position and downward stroke.

As illustrated in FIGS. 1, 2, 4 and 5, the machine 1 comprises a unit 6 for checking the dosing of the material M, which in turn comprises, for each doser element 3, sensor means 9 connected to the piston 8 to detect and save values V relative to the compression force exerted by the piston 8 on the dose DS inside the hollow cylinder 4, and transmitter means 10 connected to the sensor means 9 to transmit the compression force values V to receiver means 11 by sending relative transmission signals S.

The unit 6 also comprises means 12 which supply power to and cyclically activate the sensor means 9 and transmitter means 10 of each doser element 3.

Figure 5:
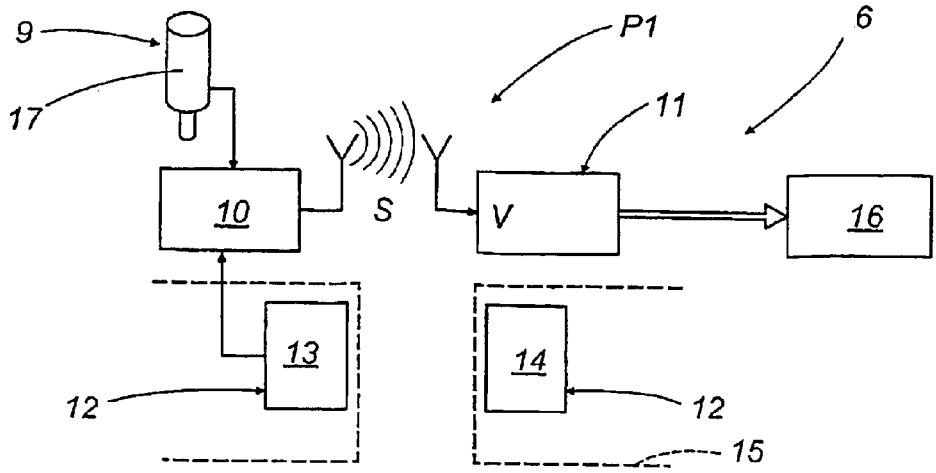
FIG. 5 is a flow diagram illustrating the operation of a part of the unit illustrated in FIG. 4.

As illustrated in FIGS. 1 and 5, the power supply and cyclical activation means 12 comprise means 13 for activating the transmitter means 10, one for each doser element 3, positioned on the drum 2, and means 14 for supplying power to the activation means 13, positioned on a fixed portion 15 of the machine 1.

Figure 4:
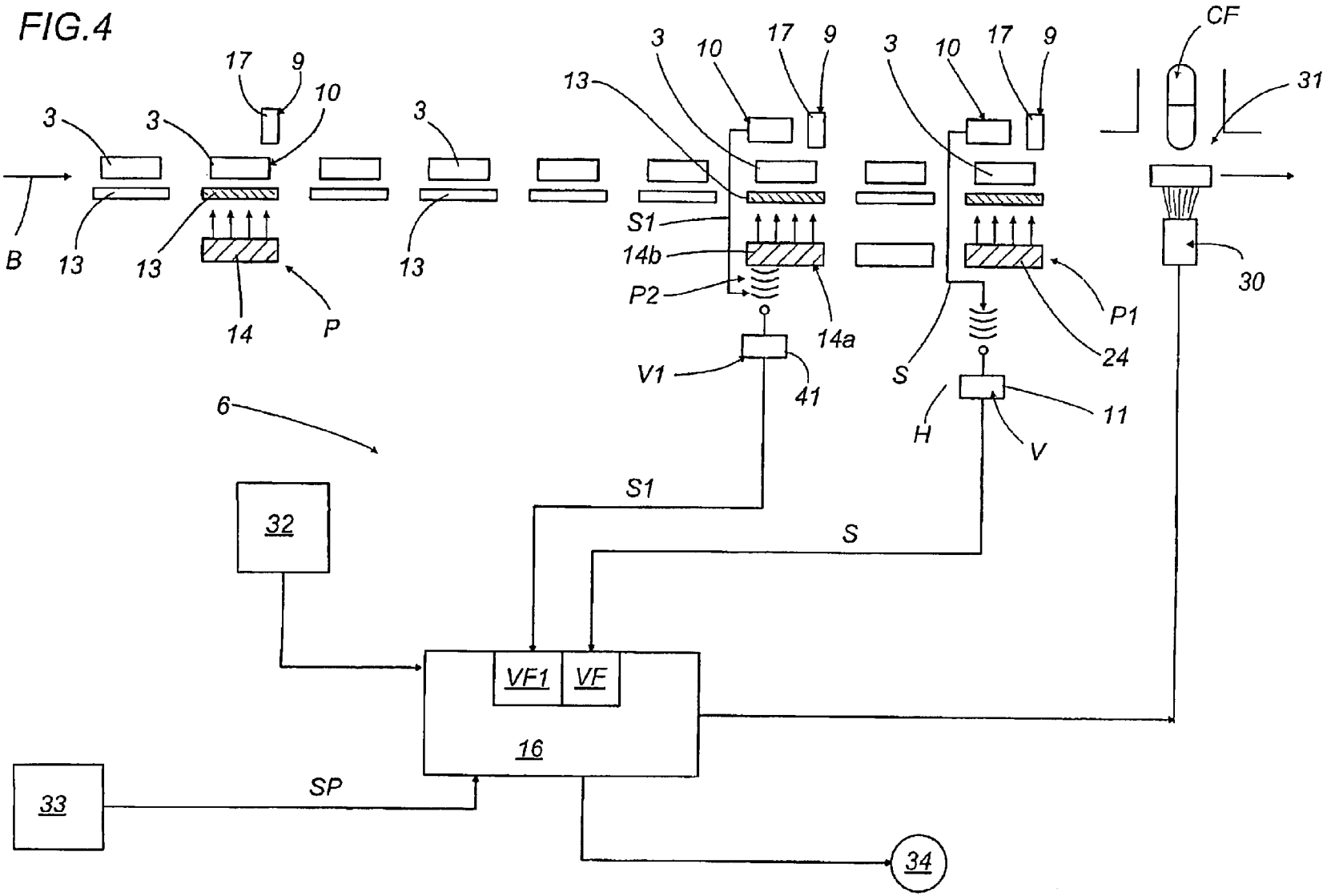
FIG. 4 is a flow diagram illustrating the operation of the unit for checking the dosing of material according to the present invention.

More specifically, as is better illustrated in FIG. 4, the power supply and cyclical activation means 12 comprise two stator elements 14 (for example, permanent magnets), positioned at relative predetermined fixed zones P and P1 of the machine 1, and a rotor element 13 (for example, a coil) connected to each of the doser elements 3. In an embodiment not illustrated, the zones P and P1 coincide, so that there is only one stator element 14.

Each rotor element 13 connected to one of the two stator elements 14 together define a transformer assembly for the transfer of electricity from the stator element 14 to a single rotor element 13 when they are positioned close to one another during drum 2 rotation in the direction B.

This transfer of electricity is designed to activate the sensor means 9 and the transmitter means 10, to allow, at the zones P and P1, detection of a value V relative to the piston 8 compression force on the dose DS, subsequently sending the value to the means 10, and, at zone P1 only, a subsequent telemetric transmission by radio frequency of a signal S from the transmitter means 10 to the receiver means 11.

Again as illustrated in the diagram in FIG. 4, further power supply and cyclical activation means 14*a* comprise a third stator element 14*b* positioned in a third fixed, predetermined zone P2 of the machine 1 to allow activation of a single rotor element 13 positioned on each of the doser elements 3. The zone P2 corresponds to the part of the machine 1 in which each dose DS is discharged into a capsule body F of a capsule CF.

The third stator element 14*b* in the zone P2 is downstream of the other two stator elements 14, relative to the direction B of rotation of the drum 2, which are in the zones P and P1 of the machine 1 fixed structure 15.

Moreover, the power supply means 14*a* power the transmitter means 10 in such a way as to allow the telemetric transmission using radio frequency and by means of a signal S1 to other means 41 of a value V1 relative to the discharging force required to discharge the dose DS into the capsule body F.

Looking more closely at the construction details in FIGS. 2 and 5, each sensor means 9 comprises a pressure transducer or strain gauge 17, preferably a load cell 17 positioned on the upper end of the cylinder 4 and connected in a known way to the piston 8. The transmitter means 10 comprise a transmission unit 10, for example, a transponder, for the signals S and S1 connected directly to the load cell 17 and which can be supplied by the rotor element 13 when the latter is activated by the stator element 14 or 14*b*.

The receiver means 11 and 41, mounted on the machine 1 fixed structure 15, are also connected, for example by a serial cable, to a processing and control device 16 of the type with a microprocessor.

In the preferred embodiment of the invention disclosed, the signals S and S1 transmitted by the transmitter means 10 to the receiver means 11 are electrical signals which are modulated, for example in frequency or amplitude.

In particular, such modulated signals S and S1 are preferably, although in a non-restricting way, of the digital type.

For example, the signals S and S1 may be binary and of the known type OOK, that is, On-Off Keying, preferably at a frequency of 433 MHz.

The signals S and S1 received by the receivers 11 and 41 are then sent in turn to the microprocessor processing device 16, so that the device 16 can process the values V and V1 of the compression force on the dose DS and, respectively, of the force for discharging the dose DS into the capsule body F, comparing them with reference values VF and VF1 saved in a device 16 memory area.

Therefore, in practice, if the value V relative to the piston 8 compression force on the dose DS detected by the load cell 17 and transmitted to the receiver 11 and then to the device 16 is not in line with the reference value VF with which it is compared, the device 16 activates means 30, preferably of the pneumatic type with a pressurised air jet, to expel the capsule CF whose dose DS was compressed with a compression force with value V, the means 30 being positioned at a machine 1 outfeed portion 31.

If, instead the value V1 relative to the discharging force exceeds the limit value VF1, the capsule filling machine 1 automatically stops, to avoid the consequent possibility of damage to the cylinder 4 and/or the piston 8.

Again as illustrated in FIG. 4, the unit 6 also comprises a device 32 for manual entry of a weight value to be the predetermined value for the doses DS of material M which will fill the capsules CF in the machine 1. Similarly, a value VF1 corresponding to a limit force for discharging the dose DS into the capsule body F by the piston 8 can also be set manually.

The device 32 is connected, for example by a serial cable, to the microprocessor device 16, whose memory contains a special algorithm for conversion of the above-mentioned weight value (for example expressed in milligrams) into a corresponding thrust force value (for example expressed in Newtons) which must be generated by the pistons 8 and which will define the reference values VF and VF1.

The microprocessor device 16 is also connected to a device 33 for weighing the finished capsules CF with a predetermined statistical cyclicity.

This device 33 is designed to send the microprocessor device 16 a signal SP equivalent to the actual weight of the capsule CF to allow verification through feedback of correct operation of the comparisons made by the microprocessor device 16, and therefore, correct operation of the control unit 6.

The microprocessor device 16 also controls a device 34 for generating a feedback signal to adjust the stroke of each piston 8 in the relative hollow cylinder 4, preferably based on a mean evaluation in a given production time interval.

In practice the unit 6 operates as follows.

With the machine 1 stopped, the operator uses the device 32 to set the weight value which will be the predetermined value for the doses DS of material M that will fill the capsules CF. In this way, the device 16 can process the piston 8 compression force reference value VF. The discharging force limit value VF1 is set in the same way.

At this point the machine 1 may begin the production cycle and when each of the doser elements 3, during continuous rotation of the drum 2, is cyclically adjacent to the first stator element 14 fixed in the first predetermined zone P the load cell 17 is energised by the rotor 13, in turn activated by the stator 14, and can record the piston 8 compression force on the dose DS inside the cylinder 4.

Next, the doser element 3 moves to the second fixed zone P1 in which the second stator element 14 is present.

The load cell 17 energised by the rotor 13 sends the value V relative to the piston 8 compression force previously recorded to the transmitter 10, which is also energised by the rotor 13 and transmits the signal S to the fixed receiver 11 which, in turn, sends the same signal S to the microprocessor device 16.

In this way, the device 16 can compare the value V sent by means of the signal S with the reference value VF and make the following choices: if the value V lies within the predetermined range set around VF the finished capsule CF is then fed out of the machine 1 as normal at the portion 31. If the value V is unacceptable relative to the value VF, that is to say, if the value V is not within the predetermined range around VF, the device 16 activates the rejection means 30 to expel and reject the capsule CF from the capsule filling machine 1 into a rejects bin (not illustrated).

Continuous movement of the drum 2 in the direction B then brings the doser element 3 to the third stator element 14*b* positioned in the predetermined machine 1 zone P2, again activating the load cell 17 to record the value V1 relative to the discharging force exerted by the piston 8 on the dose DS during dose DS discharging into the capsule body F.

This value V1 is immediately sent by means of the signal S1, from the transmitter 10 to the fixed receiver 41 and then to the microprocessor device 16.

The microprocessor device compares it with the reference value VF1 previously entered using the device 32, to check that the discharging force is correct: if the value V1 is lower than the limit value VF1 the production cycle continues. Otherwise, the machine 1 stops to prevent breakage or damage to the cylinder 4 and/or the piston 8.

The microprocessor device 16 is also designed to activate the device 34 which adjusts the stroke of the piston 8 whose compression value V was detected outside the predetermined range, to adjust the stroke of the piston 8.

To guarantee the efficiency of the checking system implemented by the microprocessor device 16, capsules CF considered to be of the correct weight are weighed on the weighing device 33 with a predetermined statistical cyclicity.

This device 33 sends a signal SP to the microprocessor device 16 equivalent to the actual weight of the capsule CF obtained, so as to verify the correct operation of the comparisons made by the device 16.

In the event of discrepancies between the actual weight and the data saved by the device 16, the operator may act directly or there may be an automatic system in the device 16 for correcting the comparison data.

A control unit 6 structured in this way, therefore, achieves the preset aims thanks to an extremely rapid system for checking the dosing of all capsules produced in the continuous-motion capsule filling machine 1, practically in real time, thanks to the system for radio frequency transmission of modulated electrical signals, without slowing down capsule filling machine 1 production at all.

The high speed, precision and flexibility of the system allow its use on all types of continuous-motion capsule filling machines and even on those with alternating motion, with both high and low production speeds.

The invention described can be subject to modifications and variations without thereby departing from the scope of the inventive concept. Moreover, all the details of the invention may be substituted by technically equivalent elements.

What is claimed is:

1. A unit (6) for checking the dosing of pharmaceutical material (M) in a capsule filling machine (1) for the production of capsules (CF) of the type with a capsule lid (C) and a capsule body (F), the machine (1) comprising a fixed structure (15) fitted with a rotary drum (2) for supporting a plurality of capsules (CF) on its edge, opening each capsule (CF) by separating the capsule lid (C) from the capsule body (F), filling the capsule body (F) with a dose (DS) of material (M), then closing the capsule body (F) again with the relative capsule lid (C); the rotary drum (2) having a tank (5) containing the pharmaceutical material (M) and supporting a plurality of doser elements (3), each comprising at least one piston (8) sliding inside a hollow cylinder (4) to pick up and compress a dose (DS) of material (M) from the tank (5) and discharge it into a capsule body (F) of a capsule (CF); the unit (6) being characterised in that it comprises sensor means (9) attached to each piston (8) for detecting a piston (8) thrust value (V; V1) on the dose (DS); transmitter means (10) connected to the sensor means (9) for transmitting the value (V; V1) to a receiver element (11; 41) by the telemetric transmission of a relative signal (S; S1), said receiver element (11; 41) being fixed on the machine (1) in at least one zone (P1; P2) of the fixed structure (15); there also being power supply means **(12, 14*a*) for cyclically activating the sensor means (9) and the transmitter means (10) during drum (2)** rotation.

2. The unit according to claim 1, characterised in that the signal (S; S1) is transmitted in radio frequency.

3. The unit according to claim 1 or 2, characterised in that the signal (S; S1) is a modulated signal.

4. The unit according to claim 1, characterised in that the sensor means (9) comprise a load cell (17) connected to each of the pistons (8) for detecting a value (V) relative to the piston (8) compression force on the dose (DS) and for sending a signal (S) to the receiver element (11) through the transmitter means (10).

5. The unit according to claim 1, characterised in that the sensor means (9) comprise a load cell (17) connected to each of the pistons (8) for detecting a value (V1) relative to the piston (8) discharging force on the dose (DS) while discharging the dose (DS) into the capsule body (F) and for sending a signal (S1) to the receiver element (41) through the transmitter means (10).

6. The unit according to claim 1, characterised in that the power supply means **(12; 14*a*) comprise a stator element (14; 14*b*) in a fixed position in at least one zone (P, P1; P2) of the fixed structure (15) and a rotor element (13) attached to each of the rotary drum (2) doser elements (3)**.

7. The unit according to claim 1, characterised in that it also comprises a processing and control device (16) connected to the receiver element (11; 41) and to capsule (CF) rejection means (30); the processing and control device (16) being designed to compare the value (V; V1) received from the receiver element (11; 41) by means of the signal (S; S1) with a relative reference value (VF; VF1) and to activate the rejection means (30) if the value (V; V1) is unacceptable relative to the reference value (VF; VF1).

8. The unit according to claim 7, characterised in that it comprises a device (32) for manual data entry, connected to the processing and control device (16), for generating the reference value (V1; VF1) in the processing and control device (16).

9. The unit according to claim 7 or 8, characterised in that it also comprises a device (34) for generating a feedback signal to adjust the stroke of each piston (8) in the relative hollow cylinder (4), this device being controlled by the processing and control device (16).

10. The unit according to claim 1, characterised in that it also comprises a device (33) for weighing the capsules (CF), this device being controlled by the processing and control device (16).

* * * * *